United States Patent [19]

Durland et al.

[11] Patent Number: 5,075,734

[45] Date of Patent: Dec. 24, 1991

[54] SHEET TRANSPORT SYSTEM WITH IMPROVED REGISTRATION

[75] Inventors: Scott C. Durland, Rochester; James R. Cassano, Penfield; Richard M. Dastin, Fairport; Michele D. Taber, Rochester; Vittorio Castelli, Yorktown Heights; Daniel R. Shavers, Rochester, all of N.Y.

[73] Assignee: Xerox Corporation, Stamford, Conn.

[21] Appl. No.: 630,685

[22] Filed: Dec. 20, 1990

[51] Int. Cl.[5] ..... G03G 15/00

[52] U.S. Cl. ..... 355/312; 355/309; 355/326; 271/188

[58] Field of Search ..... 355/312, 309, 308, 326; 271/188, 209

[56] References Cited

U.S. PATENT DOCUMENTS

| | | | |
|---|---|---|---|
| 4,118,025 | 10/1978 | Konars et al. | 271/273 |
| 4,421,306 | 12/1983 | Muka | 271/5 |
| 4,441,390 | 4/1984 | Hechler et al. | 83/154 |
| 4,558,944 | 12/1985 | Bothner | 355/309 |
| 4,669,853 | 6/1987 | Sosinski et al. | 271/188 X |
| 4,697,512 | 10/1987 | Simeth | 101/142 |
| 4,849,795 | 7/1989 | Spehrley, Jr. et al. | 355/317 |
| 4,905,052 | 2/1990 | Cassano et al. | 355/312 |
| 4,928,141 | 5/1990 | Poehlein et al. | 355/208 |
| 4,941,021 | 7/1990 | Uchida et al. | 355/309 X |
| 5,012,290 | 4/1991 | Berkes et al. | 355/271 |

*Primary Examiner*—R. L. Moses

*Attorney, Agent, or Firm*—Paul J. Maginot

[57] ABSTRACT

An apparatus which advances a sheet through a transfer zone and into registration with information developed on a moving member. The sheet is advanced to a position wherein a leading portion thereof is within the transfer zone and a trailing portion thereof is immediately behind the transfer zone relative to the forward direction of movement of the moving member. The leading portion of the sheet is advanced through the transfer zone at a first velocity and the trailing portion of the sheet is advanced in a region immediately behind the transfer zone at a second velocity, which is greater than the first velocity, so as to create a buckle in the trailing portion of the sheet in the region. The buckle functions to eliminate relative velocity between the photoconductive belt and any portion of sheet within the transfer zone so as to substantially eliminate slip between the sheet and the photoconductive belt.

16 Claims, 6 Drawing Sheets

SHEET TRANSPORT SYSTEM WITH IMPROVED REGISTRATION

This invention relates generally to an electrophotographic printing machine, and more particularly concerns a sheet transport for moving a sheet in a path to enable a toner image to be transferred thereto. The invention also particularly concerns a sheet transport for moving a sheet in a recirculating path to enable successive toner powder images to be transferred thereto in superimposed registration with one another.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing toner into contact therewith. This forms a toner image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray to a path internal the electrophotographic printing machine where a toner image is transferred thereto and then to an output catch tray for subsequent removal therefrom by the machine operator. In the process of multi-color printing, the copy sheet moves from an input tray through a recirculating path internal the printing machine where a plurality of toner images is transferred thereto and then to an output catch tray for subsequent removal. With regard to multi-color printing, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

Some systems which have been designed for transporting a copy sheet into registration with a toner image developed on a moving member accelerate the copy sheet during transfer of the toner image from the moving member to the copy sheet. Such acceleration may occur when the leading portion of the sheet is traveling through the transfer zone while at the same time the trailing portion of the sheet is being negotiated through a nonlinear path. The above acceleration may cause a deterioration of the integrity of the image produced on the copy sheet due to slip between the copy sheet and the moving member while the sheet is traveling through the transfer zone. An example of the above deterioration is a blurred or smeared image produced on the copy sheet.

The following disclosures may be relevant to various aspects of the present invention:

| |
|---|
| U.S. Pat. No. 4,118,025<br>Patentee: Konars et al.<br>Issued: October 3, 1978 |
| U.S. Pat. No. 4,421,306<br>Patentee: Muka<br>Issued: December 20, 1983 |
| U.S. Pat. No. 4,441,390<br>Patentee: Hechler et al.<br>Issued: April 10, 1984 |
| U.S. Pat. No. 4,697,512<br>Patentee: Simeth<br>Issued: October 6, 1987 |
| U.S. Pat. No. 4,849,795<br>Patentee: Spehrley, Jr. et al.<br>Issued: July 18, 1989 |
| U.S. Pat. No. 4,905,052<br>Patentee: Cassano et al.<br>Issued: February 27, 1990 |

The relevant portions of the foregoing disclosures may be briefly summarized as follows:

U.S. Pat. No. 4,118,025 discloses a document conveying apparatus having a plurality of equally spaced gripping members. As the document is fed to the apparatus, the leading edge of the document is gripped between two gripping members and thereafter transported to a desired location.

U.S. Pat. No. 4,441,390 describes a sheet separating and transport apparatus in which tear-off rollers gently grip sheets. A pair of belts are provided which are positionable so as to grip the leading edge of a sheet as it is being fed by a conveyor belt.

U.S. Pat. No. 4,421,306 describes a document feeder which includes a rotating vacuum feeder tube and a platen vacuum transport for advancing a sheet from a first position to a second position within a printing machine thereby enabling an image to be placed on the sheet.

U.S. Pat. No. 4,697,512 discloses a sheet gripper system having regular sheet grippers with additional sheet grippers provided in spaces between the regular grippers. The additional grippers are provided so that the front edge of the sheet is held by approximately twice the number of grippers before it enters the printing area, thereby reducing the tensile stress on the sheet as it passes through the printing zone by at least approximately half.

U.S. Pat. No. 4,849,795 describes an apparatus for moving a sheet in a recirculating path by spaced belts having a sheet gripper. The leading edge of the sheet is received by the gripper securing the sheet thereto for movement in a recirculating path. The belts move the sheet into contact with a photoconductive member in a transfer zone in synchronism with a toner image developed thereon.

U.S. Pat. No. 4,905,052 discloses a sheet transport velocity mismatch apparatus. A plate, interposed between adjacent sheet transports, supports the sheet until the leading edge thereof advances from the first sheet transport to the second sheet transport. When the leading edge of the sheet is received by the second sheet transport, the plate pivots away from the sheet to a location remote therefrom. Since the first sheet transport advances the sheet at a greater velocity than the second sheet transport, the sheet forms a buckle to compensate for velocity mismatch between the sheet transports.

In accordance with one aspect of the present invention, there is provided an apparatus for advancing a sheet through a transfer zone and into registration with information developed on a moving member. The apparatus comprises a means for advancing the sheet through the transfer zone. The apparatus further comprises means, acting in unison with the advancing means and positioned in a region immediately behind the transfer zone relative to the forward of direction of movement of the moving member, for eliminating relative velocity between the moving member and any portion of the sheet in the transfer zone so as to substantially eliminate slip between the sheet and the moving member in the transfer zone.

Pursuant to another aspect of the present invention, there is provided a printing machine of the type having a toner image developed on a moving member with a sheet being advanced through a transfer zone and into registration with the toner image. The printing machine comprises a means for advancing the sheet through the transfer zone. The printing machine further comprises means, acting in unison with the advancing means and positioned in a region immediately behind the transfer zone relative to the forward of direction of movement of the moving member, for eliminating relative velocity between the moving member and any portion of the sheet in the transfer zone so as to substantially eliminate slip between the sheet and the moving member in the transfer zone.

Other features of the present invention will become apparent as the following description proceeds and upon reference to the drawings, in which.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
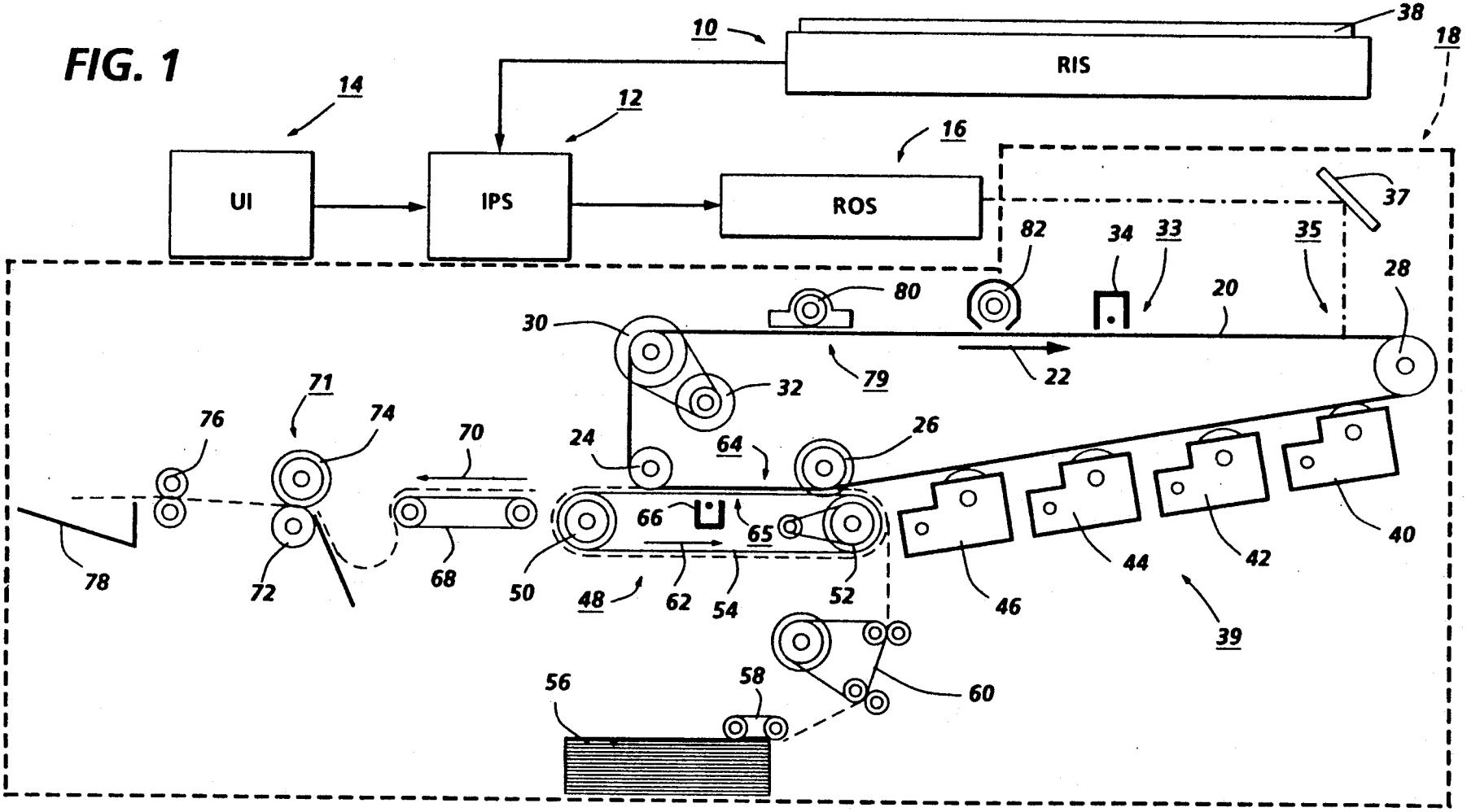
FIG. 1 is a schematic elevational view illustrating an electrophotographic printing machine incorporating the features of the present invention therein.

For a general understanding of the features of the present invention, reference is made to the drawings. In the drawings, like references have been used throughout to designate identical elements. FIG. 1 is a schematic elevational view of an illustrative electrophotographic printing machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains docuument illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material and the third latent image is adapted to be developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. Roller 52 is a vacuum roller and will be described in further detail below. A sheet gripper, generally indicated by the reference numeral 84 (see FIGS. 2–6), extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. Further details of the sheet transport system will be discussed hereinafter with reference to FIGS. 2-9. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
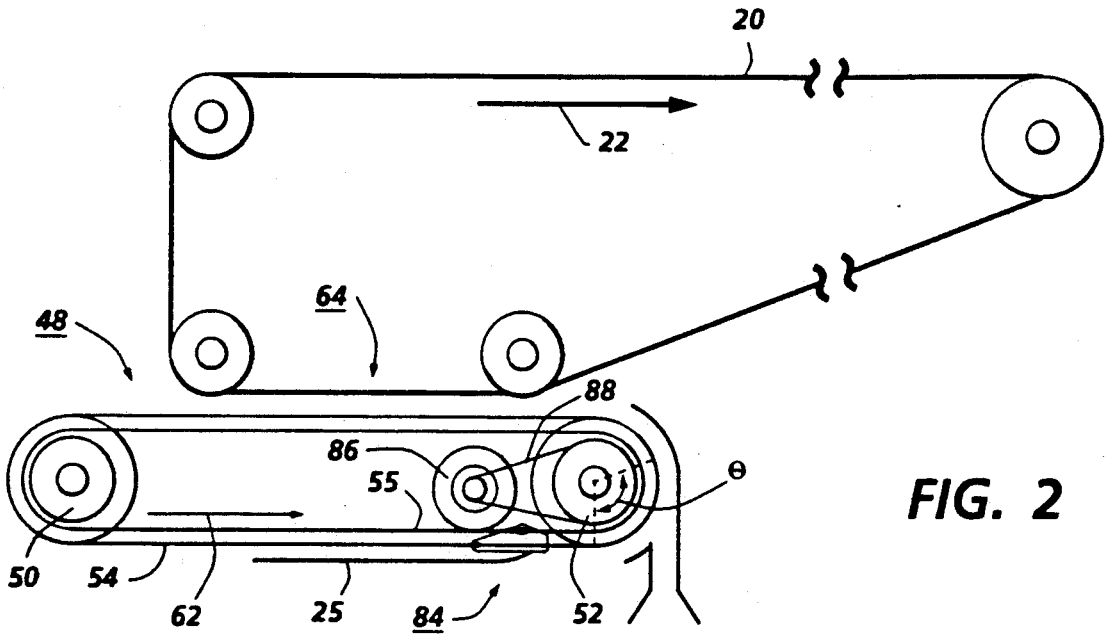
FIG. 2 is a schematic elevational view showing further details of the sheet transport system used in the electrophotographic printing machine of FIG. 1 and also showing the sheet at a position just prior to being subjected to the influence of the vacuum roller of the sheet transport system.

Referring now to FIG. 2, sheet gripper 84 is suspended between two spaced apart timing belts 54 mounted on roller 50 and vacuum roller 52 (see also FIGS. 3-7). Timing belts 54 define a continuous path of movement of sheet gripper 84. A motor 86 is coupled to vacuum roller 52 by a drive belt 88. Sheet gripper 84 includes a pair of guide members 85. A pair of spaced apart and continuous tracks 55 are respectively positioned substantially adjacent belts 54. Tracks 55 are respectively defined by a pair of track supports 57. Guide members 85 are slidably positioned within a respective track 55 (see FIGS. 5 and 6). Sheet gripper 84 further includes an upper sheet gripping portion 87 and a lower sheet gripping portion 89 which are spring biased toward each other. The sheet gripper includes a pair of cams (not shown) which function to open and close the gripping portions at predetermined intervals. In the closed position, gripping portion 87 cooperates with gripping portion 89 to grasp and securely hold the leading edge of sheet 25. The area at which the gripping portions 87 and 89 grasp sheet 25 defines a gripping nip, generally indicated by the reference numeral 91 (see FIGS. 5 and 7). A silicone rubber coating (not shown) may be positioned upon lower sheet gripping portion 89, near gripping nip 91, in order to increase the frictional grip of sheet 25 between the gripping portions. Belts 54 are respectively connected to the opposed side marginal regions of sheet gripper 84 by a pair of pins 83. The belts are connected to the sheet gripper behind the leading edge of sheet 25 relative to the forward direction of movement of belts 54, as indicated by arrow 62, when sheet 25 is being transported by sheet transport 48. The sheet gripper is driven by the belts at the locations where the sheet gripper and the belts are connected. In the above configuration, the distance between the leading edge of the sheet and the location at which the sheet gripper is connected to the belts is approximately equal to or greater than one half of the length of the radius of roller 50.

Figure 8:
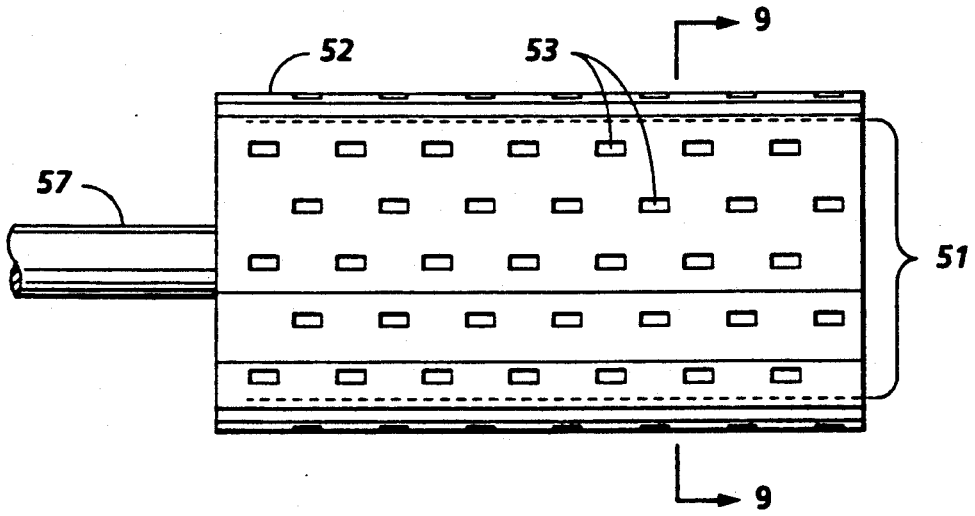
FIG. 8 is a schematic elevational view showing further details of the vacuum roller of the sheet transport system used in the electrophotographic printing machine of FIG. 1.
Figure 9:
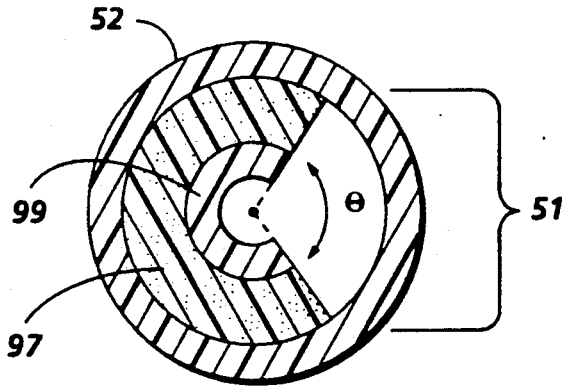
FIG. 9 is a sectional elevational view taken in the direction of arrows 9—9 in FIG. 8 showing further details of the vacuum roller of the sheet transport system used in the electrophotographic printing machine of FIG. 1.

FIGS. 8 and 9 show vacuum roller 52 in a more detailed manner. Vacuum roller 52 is substantially hollow and has a plurality of vacuum ports 53 positioned in a pattern 360° about its surface. Roller 52 is vacuum coupled to a vacuum source, schematically illustrated by a tube 57, at one of its ends and is sealed in a conventional manner at its other end. Vacuum source 57 is connected to a stationary substantially cylindrical inner roll 99 (see FIG. 9) which is positioned internal to roller 52. Inner roll 99 is co-axial with roller 52 and has a 110° aperture throughout its length. The purpose of the aperture is to allow the vacuum from vacuum source 57 to be applied to a stationary segment 51 of the surface of roller 52 via certain of vacuum ports 53. Segment 51 spans the portion of the surface encompassed by the bounds of an angle $\theta$ with respect to the center axis of roller 52 as shown in FIG. 9. Angle $\theta$ is preferably 110°. In order to increase the effectiveness of the transmission of the vacuum from vacuum source 57 to the vacuum ports within segment 51 of roller 52, a foam seal 97 is interposed between inner roll 99 and roller 52. Seal 97 is attached to the outside surface of inner roll 99. Since inner roll 99 is stationary, seal 97 also remains stationary. When activated, vacuum source 57 causes a corresponding vacuum at each of ports 53 within segment 51. Note that as roller 52 rotates about its center axis, segment 51 will remain stationary and will continually be comprised of a new portion of the surface of roller 52.

In operation, belts 54 drive sheet gripper 84 and consequently sheet 25 at a constant velocity through transfer zone 64. As the sheet enters the gap between photoconductive belt 20 and the continuous path defined by the movement of sheet gripper 84, the sheet adheres to photoconductive belt 20 as a result of electrostatic forces imparted to the sheet by a conrotrol (not shown). The sheet travels in this manner though the transfer zone. However, when the leading portion of sheet 25 is being transported through the transfer zone, the leading portion of the sheet may accelerate due to disturbances applied to it from the trailing portion of the sheet which is in region immediately behind the transfer zone relative to the forward direction of movement of photoconductive belt 20. The sheet transport system of the present invention provides for decoupling of the disturbances of the trailing portion of the sheet from any portion of the sheet in the transfer zone. This is important in order to prevent slip between the copy sheet and the photoconductive belt in the transfer zone and thus provides for accurate transfer of the developed toner image from the photoconductive belt to the copy sheet thereby preserving the integrity of the image produced on the copy sheet.

Figure 3:
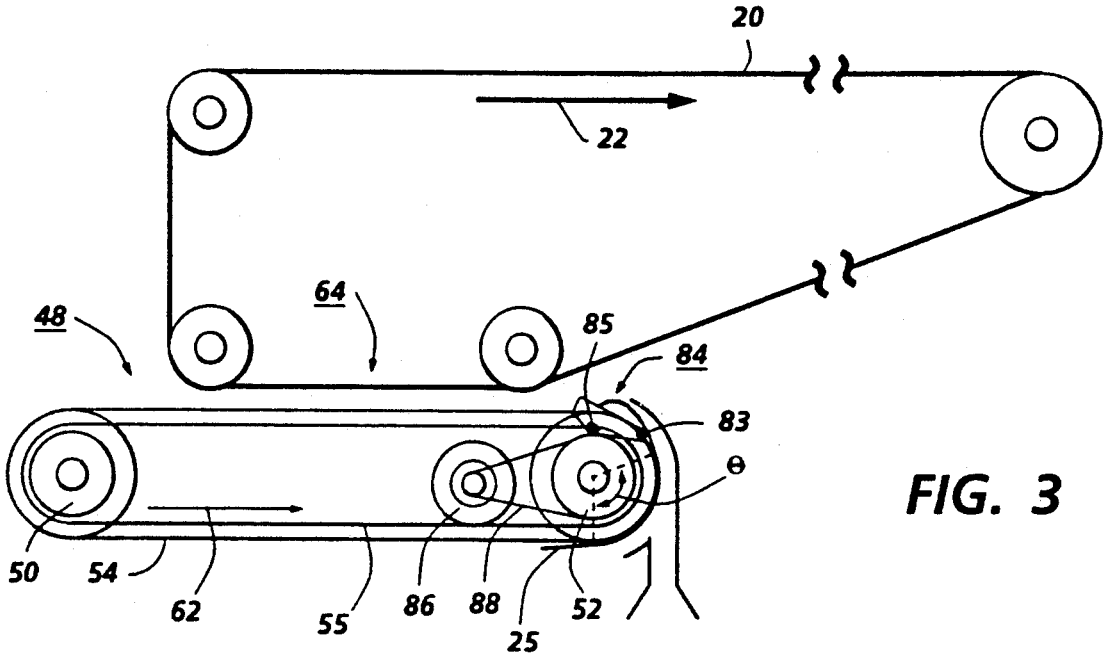
FIG. 3 is a schematic elevational view showing further details of the sheet transport system used in the electrophotographic printing machine of FIG. 1 and also showing the sheet at a position where its trailing portion is under the influence of the vacuum roller of the sheet transport system.
Figure 4:
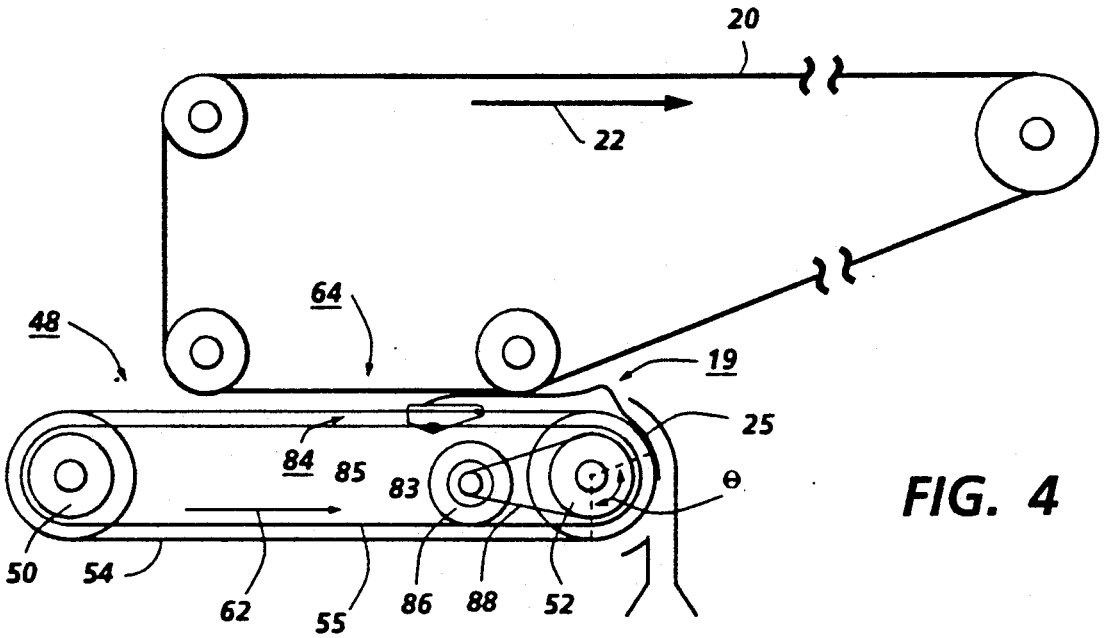
FIG. 4 is a schematic elevational view showing further details of the sheet transport system used in the electrophotographic printing machine of FIG. 1 and also showing the sheet at a position just prior to being released from the influence of the vacuum roller of the sheet transport system.
Figure 5:
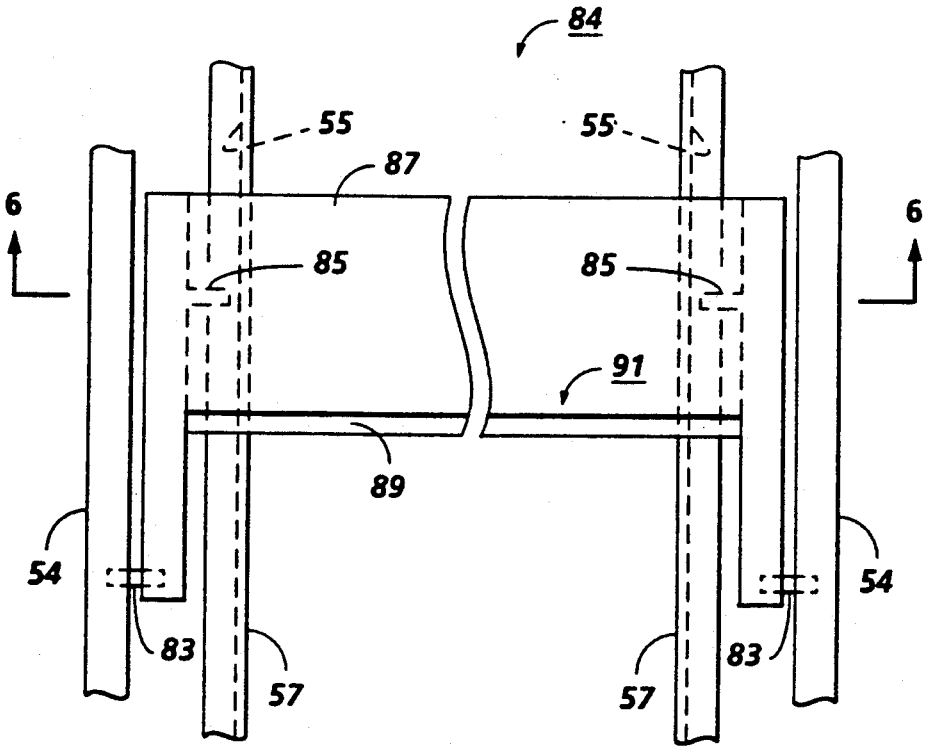
FIG. 5 is a schematic planar view showing the sheet gripper of the sheet transport system used in the electrophotographic printing machine of FIG. 1.
Figure 6:
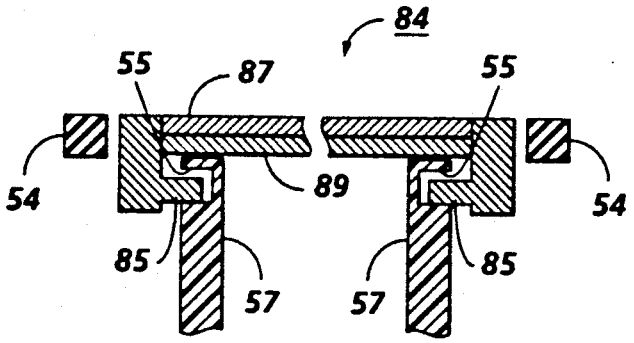
FIG. 6 is a sectional elevational view taken in the direction of arrows 6—6 in FIG. 5.
Figure 7:
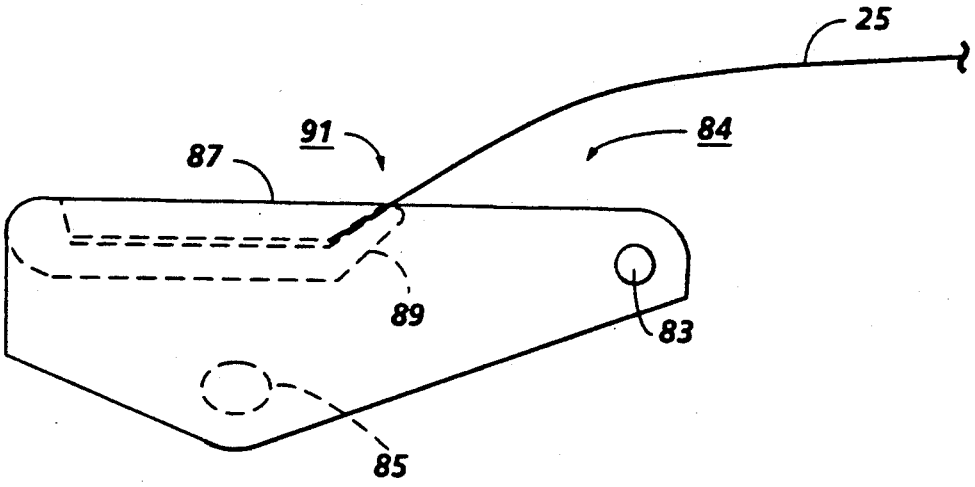
FIG. 7 is a schematic elevational view showing the sheet gripper of the sheet transport system used in the electrophotographic printing machine of FIG. 1.

The sheet gripper and the vacuum roller cooperate so as to transport the sheet through the turn defined by the vacuum roller. More specifically, the sheet gripper advances the sheet through the above turn such that the sheet coincides with stationary segment 51 of the vacuum roller as the roller rotates about its central axis. As a result, the sheet is drawn into contact with the vacuum roller at segment 51 due to the suction action of vacuum ports 53. FIGS. 2–4 depict the movement of sheet 25 from a position just prior to being subjected to the influence of segment 51 of vacuum roller 52 to a position just prior to being released from the influence of segment 51 of vacuum roller 52 relative to the forward direction of movement of photoconductive belt 20. FIG. 2 shows the sheet at a position just prior to negotiating the turn defined by vacuum roller 52. At this location, no portion of the sheet is under the influence of segment 51 of vacuum roller 52. FIG. 3 shows the sheet negotiating the turn defined by the vacuum roller. At this location, the trailing portion of the sheet is under the influence of segment 51 of the vacuum roller. FIG. 4 shows a leading portion of the sheet in the transfer zone and a trailing portion of the sheet in a region immediately behind the transfer zone relative to the forward direction of movement of the photoconductive belt, as indicated by arrow 22. At this location, a part of the trailing portion of the sheet is under the influence of segment 51 of the vacuum roller. Further, as shown in FIG. 4, a buckle (indicated generally by reference numeral 19) is formed in a portion of sheet 25 in a region immediately behind the transfer zone relative to the forward direction of movement of photoconductive belt 20. As the trailing portion of sheet enters the transfer zone, the sheet is released from the influence of segment 51 of the vacuum roller. When this occurs, the buckle which was created in the trailing portion of the sheet dissipates. The small remaining trailing portion of the sheet in the region immediately behind the transfer zone relative to the forward movement of the photoconductive belt is then drawn through the transfer zone.

The function of buckle 19 is to eliminate relative velocity between photoconductive belt 20 and any portion of sheet 25 within the transfer zone so as to substantially eliminate slip between the sheet and the photoconductive belt. This is true since a disturbance in the trailing portion of the sheet which causes such portion to slow down will merely decrease the size of buckle 19 and not transmit the physical effect of the disturbance to the leading portion of the sheet located in the transfer zone (see FIG. 4). Disturbances in the trailing portion of the sheet may exist due to a variety of reasons such as friction between the trailing portion of the sheet and the physical structure of the printing machine adjacent the path of movement of the sheet.

Buckle 19 is formed when the sheet gripper 84 and a leading portion of sheet 25 is advanced to a position within transfer zone 64 relative to the forward direction of movement of photoconductive belt 20 while a trailing portion of sheet 25 is advanced to a position within a region immediately behind the transfer zone relative to the forward direction of movement of the moving member and the leading portion of sheet 25 is caused to travel at a first velocity (which is determined by the velocity of the photoconductive belt) and the trailing portion of sheet 25 is caused to travel at a second velocity (which is determined by the velocity of the vacuum ports on the surface of the vacuum roller within segment 51), which is greater than the first velocity. The velocity of such vacuum ports is a function of the speed of motor 86 and the radius of vacuum roller 52 and is designed to be greater than the velocity of the leading portion of the sheet in the transfer zone (which is determined by the photoconductive belt). Again, as stated above, the buckle functions to eliminate relative velocity between the photoconductive belt and any portion of the sheet within the transfer zone so as to substantially eliminate slip between the sheet and the photoconductive belt thereby maintaining the integrity of the imaged transferred to the copy sheet.

Copending U.S. patent application Ser. No. 630,629 describes the formation of a buckle in a portion of the sheet immediately ahead of the transfer zone relative to the forward direction of movement of the photoconductive belt. It should be noted that the formation of a buckle in a portion of the sheet immediately ahead of the transfer zone in addition to the formation of a buckle in a portion of the sheet immediately behind the transfer zone relative to the forward direction of movement of the photoconductive belt results in the sheet being substantially isolated from forces outside the transfer zone which may disrupt accurate transfer of the toner image from the photoconductive belt to the sheet.

In recapitulation, a sheet is advanced to a position wherein a leading portion thereof is within the transfer zone and a trailing portion thereof is immediately behind the transfer zone relative to the forward direction of movement of the photoconductive belt. The leading portion of the sheet is advanced through the transfer zone at a first velocity and the trailing portion of the sheet is advanced in a region immediately behind the transfer zone at a second velocity, which is greater than the first velocity, so as to create a buckle in the trailing portion of the sheet in the region. The buckle functions to eliminate relative velocity between the photoconductive belt and any portion of sheet within the transfer zone so as to substantially eliminate slip between the sheet and the photoconductive belt.

It is, therefore, apparent that there has been provided in accordance with the present invention, a sheet transport system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for advancing a sheet through a transfer zone and into registration with information developed on a moving member, comprising:

means for advancing the sheet through the transfer zone;

means, acting in unison with said advancing means and positioned in a region immediately behind the transfer zone relative to the forward of direction of movement of the moving member, for eliminating relative velocity between the moving member and any portion of the sheet in the transfer zone so as to substantially eliminate slip between the sheet and the moving member in the transfer zone.

2. The apparatus of claim 1, wherein said eliminating means forms a buckle in a portion of the sheet in the region.

3. The apparatus of claim 2, wherein:

said advancing means advances a leading portion of the sheet at a first velocity in the transfer zone; and said eliminating means advances the trailing portion of the sheet at a second velocity, which is greater than the first velocity, in the region so as to form the buckle.

4. The apparatus of claim 2, wherein said eliminating means comprises a rotatable substantially hollow roller having a plurality of vacuum ports on its surface, said roller further having a vacuum source attached thereto.

5. The apparatus of claim 4, wherein said vacuum source is stationary.

6. The apparatus of claim 4, wherein said vacuum source is applied to a segment of the surface of said roller.

7. The apparatus of claim 6, wherein the segment comprises about 110° of the surface of said roller.

8. A printing machine of the type having a toner image developed on a moving member with a sheet being advanced through a transfer zone and into registration with the toner image, comprising:

means for advancing the sheet through the transfer zone;

means, acting in unison with said advancing means and positioned in a region immediately behind the transfer zone relative to the forward of direction of movement of the moving member, for eliminating relative velocity between the moving member and any portion of the sheet in the transfer zone so as to substantially eliminate slip between the sheet and the moving member in the transfer zone.

9. The printing machine of claim 8, wherein said eliminating means forms a buckle in a portion of the sheet in the region.

10. The printing machine of claim 9, wherein:

said advancing means advances a leading portion of the sheet at a first velocity in the transfer zone; and said eliminating means advances the trailing portion of the sheet at a second velocity, which is greater than the first velocity, in the region so as to form the buckle.

11. The printing machine of claim 9, wherein said eliminating means comprises a rotatable substantially hollow roller having a plurality of vacuum ports on its surface, said roller further having a vacuum source attached thereto.

12. The printing machine of claim 11, wherein said vacuum source is stationary.

13. The printing machine of claim 11, wherein said vacuum source is applied to a segment of the surface of said roller.

14. The printing machine of claim 13, wherein the segment comprises about 110° of the surface of said roller.

15. The printing machine of claim 8, wherein each of a plurality of toner images are successively developed on the moving member and advanced into registration with the sheet.

16. The printing machine of claim 15, wherein each of the toner images is a different color.

* * * * *